US009146061B2

(12) United States Patent
Farlow et al.

(10) Patent No.: US 9,146,061 B2
(45) Date of Patent: Sep. 29, 2015

(54) FASTENER-LESS RETAINED HEAT EXCHANGER MOUNTING BRACKET FOR LOW INSTALLATION FORCE

(71) Applicants: DENSO International America, Inc., Southfield, MI (US); DENSO CORPORATION, Kariya-shi, Aichi-ken (JP)

(72) Inventors: Parker Farlow, Warren, MI (US); Joshua Guerra, Beverly Hills, MI (US); Sang Bae Park, Northville, MI (US); Kazuo Tsuchihashi, Kariya (JP); Kentaro Takahashi, Kariya (JP)

(73) Assignees: DENSO International America, Inc., Southfield, MI (US); DENSO CORPORATION, Kariya-shi, Aichi-ken (JP)

( * ) Notice: Subject to any disclaimer, the term of this patent is extended or adjusted under 35 U.S.C. 154(b) by 0 days.

(21) Appl. No.: 13/887,883

(22) Filed: May 6, 2013

(65) Prior Publication Data

US 2014/0326434 A1 Nov. 6, 2014

(51) Int. Cl.
*F28F 9/00* (2006.01)
*F28F 9/007* (2006.01)

(52) U.S. Cl.
CPC ..... *F28F 9/007* (2013.01)

(58) Field of Classification Search
CPC ... F28F 9/002; F28F 2275/085; F28F 9/0224; B60K 11/04; B62D 25/084
USPC ..... 165/67
See application file for complete search history.

(56) References Cited

U.S. PATENT DOCUMENTS

| | | | | |
|---|---|---|---|---|
| 5,205,349 | A * | 4/1993 | Nagao et al. | 165/67 |
| 5,429,181 | A * | 7/1995 | Tordjeman | 165/67 |
| 5,570,737 | A * | 11/1996 | Tokutake | 165/67 |
| 5,685,364 | A * | 11/1997 | Harris | 165/67 |
| 6,513,579 | B1 | 2/2003 | Kent et al. | |
| 6,901,992 | B2 * | 6/2005 | Kent et al. | 165/67 |
| 7,040,380 | B1 * | 5/2006 | O'Brien | 165/67 |
| 7,117,927 | B2 | 10/2006 | Kent et al. | |
| 8,522,860 | B2 * | 9/2013 | Kersting et al. | 165/67 |
| 2007/0062671 | A1 * | 3/2007 | Sugimoto et al. | 165/67 |
| 2007/0144713 | A1 * | 6/2007 | Sugimoto et al. | 165/140 |
| 2008/0156456 | A1 * | 7/2008 | Hamida et al. | 165/67 |
| 2010/0078149 | A1 * | 4/2010 | Yoshimitsu et al. | 165/67 |
| 2010/0270006 | A1 * | 10/2010 | Kaczmarek et al. | 165/67 |
| 2011/0267771 | A1 * | 11/2011 | Cheng | 361/679.54 |
| 2012/0199318 | A1 * | 8/2012 | Dittly et al. | 165/67 |
| 2014/0096932 | A1 * | 4/2014 | Wolf et al. | 165/67 |

* cited by examiner

*Primary Examiner* — Bradley Duckworth
(74) *Attorney, Agent, or Firm* — Harness, Dickey & Pierce, P.L.C.

(57) ABSTRACT

A mounting bracket for a heat exchanger. The mounting bracket includes a heat exchanger engagement portion and a mounting portion. The heat exchanger engagement portion includes a retention member. The mounting portion extends from the heat exchanger engagement portion and is configured for fixedly mounting the mounting bracket. Cooperation between the retention member and the heat exchanger secures the heat exchanger to the mounting bracket.

14 Claims, 6 Drawing Sheets

FASTENER-LESS RETAINED HEAT EXCHANGER MOUNTING BRACKET FOR LOW INSTALLATION FORCE

FIELD

The present disclosure relates to a heat exchanger mounting bracket.

BACKGROUND

This section provides background information related to the present disclosure, which is not necessarily prior art.

Heat exchangers can be used in a variety of applications to cool or heat fluid and/or air. For example, types of automobile heat exchangers include radiators, oil coolers, and intercoolers. Heat exchangers can also be included with cabin cooling and heating systems for automobiles.

Installation of a heat exchanger, such as in an automobile, can require a large amount of installation force to secure the heat exchanger in place. The installation force can be provided with a large pneumatic machine, which may slow and generally reduce the efficiency of the installation process. A device that reduces the amount of installation force necessary to install a heat exchanger would be desirable.

SUMMARY

This section provides a general summary of the disclosure, and is not a comprehensive disclosure of its full scope or all of its features.

The present teachings provide for a mounting bracket for a heat exchanger. The mounting bracket includes a heat exchanger engagement portion and a mounting portion. The heat exchanger engagement portion includes a retention member. The mounting portion extends from the heat exchanger engagement portion and is configured for fixedly mounting the mounting bracket. Cooperation between the retention member and the heat exchanger secures the heat exchanger to the mounting bracket.

The present teachings also provide for a mounting bracket for a heat exchanger. The mounting bracket includes a first flexible sidewall, a second flexible sidewall, and a base extending between the first flexible sidewall and the second flexible sidewall. A retention member is configured to retain the mounting bracket in cooperation with the heat exchanger. The mounting portion extends from the engagement portion and is configured for fixedly mounting the mounting bracket at an installation location. The mounting bracket includes a polymer.

The present teachings still further provide for a mounting bracket for a heat exchanger. The mounting bracket includes a first sidewall configured to abut a first side of the heat exchanger, a second sidewall opposite to the first sidewall, the second sidewall configured to abut a second side of the heat exchanger, and a base portion extending between the first sidewall and the second sidewall. A retention member is configured to maintain the mounting bracket in cooperation with the heat exchanger. A mounting portion extends from at least one of the first sidewall and the second sidewall. The mounting portion is configured to secure the mounting bracket at a predetermined position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
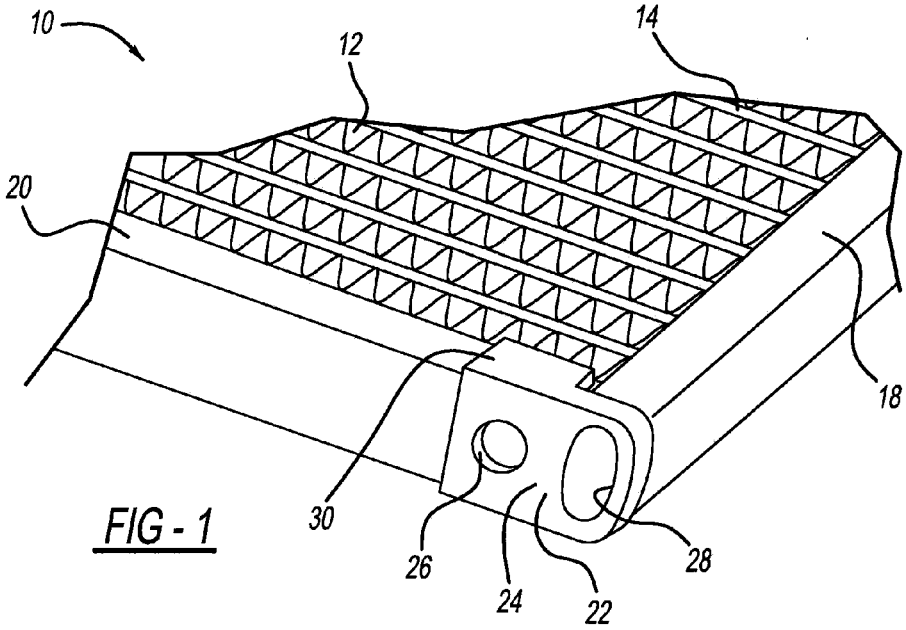
FIG. 1 is a perspective view of a heat exchanger according to the present teachings.

With initial reference to FIG. 1, a heat exchanger according to the present teachings is generally illustrated at reference numeral 10. The heat exchanger 10 includes a heat exchanger core 12, which has spaced apart tubes and air fins therebetween to facilitate heat transfer. The heat exchanger core 12, and the heat exchanger 10 in general, include a first side 14 and a second side 16 (FIG. 3) that is opposite to the first side 14. The tubes extend from a tank 18 to convey fluid from the tank 18, such as engine coolant. A side plate 20 extends perpendicular to the tank 18 and is adjacent to the tank 18.

A tank cap 22 is coupled to the heat exchanger 10 where the tank 18 and the side plate 20 meet. The tank cap 22 includes a tank cap base 24, which defines a base aperture 26. The tank cap 22 further includes a tank cover portion 28, which prevents fluid from exiting the tank 18 at an end thereof. The tank cap 22 also includes a first cap flange 30 and a second cap flange 32 (see FIG. 3 for example). The first cap flange 30 and the second cap flange 32 each extend from the tank cap base 24 along opposite sides of the side plate 20, as further described herein.

Figure 2:
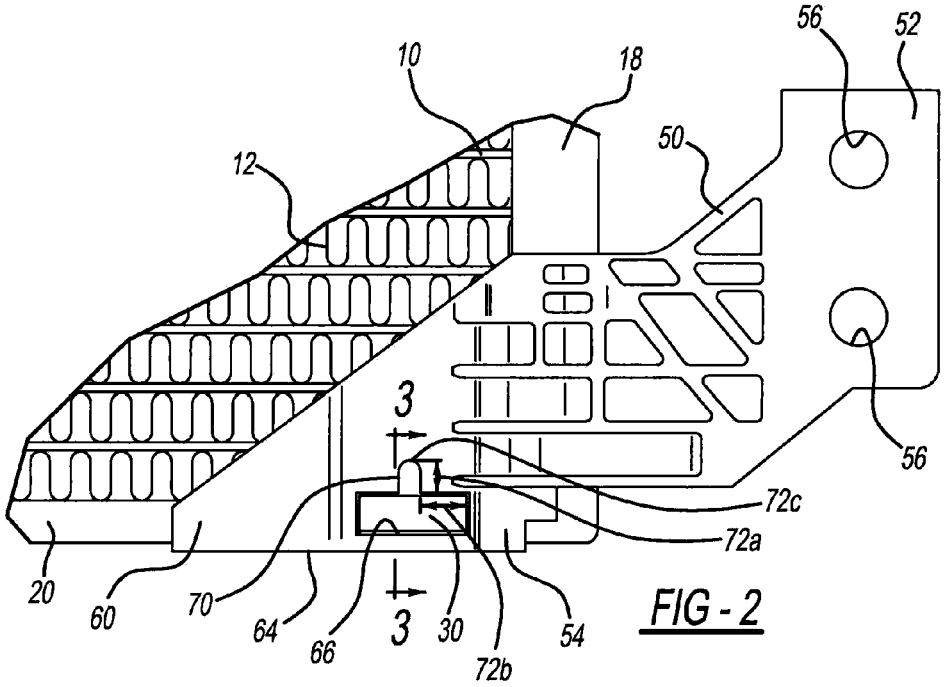
FIG. 2 is a side view of a mounting bracket according to the present teachings, the mounting bracket coupled or secured to the heat exchanger of FIG. 1 with a retention member of the mounting bracket.

FIG. 2 illustrates a mounting bracket according to the present teachings at reference numeral 50. The mounting bracket 50 generally includes a mounting portion 52 and a heat exchanger engagement portion 54. The mounting portion 52 defines a pair of mounting apertures 56. The mounting apertures 56 are each configured to receive a suitable fastener or coupling member to secure the mounting bracket 50 at any suitable installation location for the heat exchanger 10, such as at a suitable installation location within an automobile. The mounting portion 52 can be configured in any suitable manner to rigidly secure the mounting bracket 50 at any suitable location.

The heat exchanger engagement portion 54 includes a first side wall 60, a second side wall 62 (see FIG. 3 for example), and a base 64 extending between the first side wall 60 and the second side wall 62. The first side wall 60 and the second side wall 62 extend generally parallel to one another and are spaced apart a distance that is generally slightly greater than a thickness of the heat exchanger 10 in order to accommodate the heat exchanger 10 therebetween. The base 64 extends generally perpendicular to both the first side wall 60 and the second side wall 62. The first side wall 60 defines a first window 66 therein, and the second side wall 62 defines a second window 68 therein (see FIG. 3 for example). Extending from the first window 66 is a slit 70 defined by the first side wall 60. The slit 70 extends a height 72*a* from the first window 66, and is offset a distance 72*b* from an end portion of the first window 66. The slit 70 as a rounded end 72*c*. A similar slit (not shown) extends from the second window 68.

Figure 3:
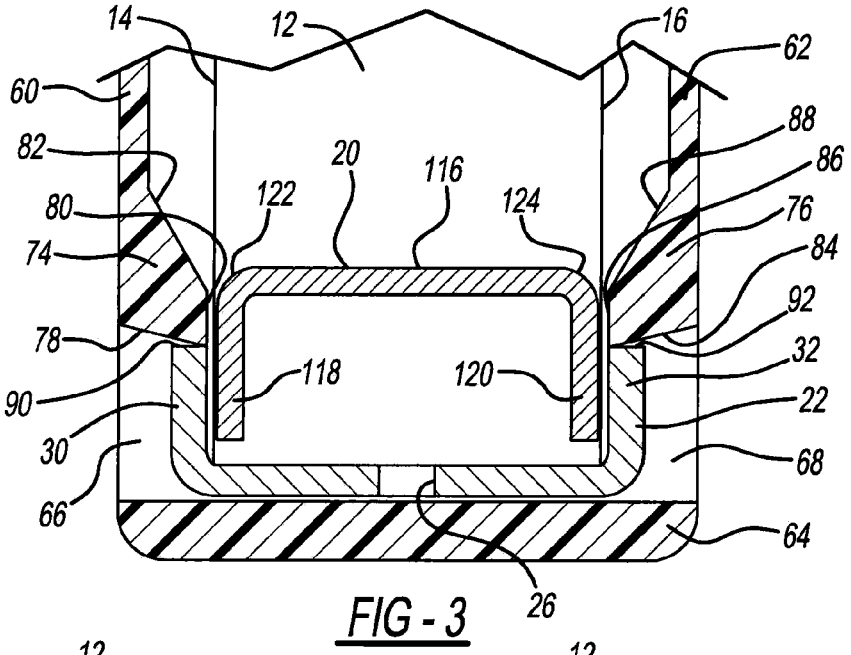
FIG. 3 is a cross-sectional view taken along line 3-3 of FIG. 2.

With additional reference to FIG. 3, the first side wall 60 includes a first flange 74 and the second side wall 62 includes a second flange 76. The first flange 74 includes an angled base 78, an inner surface 80, and an inner angled surface 82. The angled base 78 defines an upper portion of the first window 66 and is angled such that an innermost portion of the angled base 78 is closest to the base 64 of the heat exchanger engagement portion 54. Extending from the angled base 78 is the inner surface 80, which is generally planar and extends perpendicular to the base 64. The inner angled surface 82 extends from the inner surface 80.

The second flange 76 is similar to the first flange 74, and thus includes an angled base 84, an inner surface 86, and an inner angled surface 88. The angled base 84 is angled such that an innermost portion of the angled base 84 is closest to the base 64 of the heat exchanger engagement portion 54. The inner surface 86 extends from the angled base 84 and extends generally perpendicular to the base 64. The inner angled surface 88 extends from the inner surface 86 away from the base 64.

When the heat exchanger 10 is seated between the first side wall 60 and the second side wall 62 of the heat exchanger engagement portion 54, the first cap flange 30 of the tank cap 22 is arranged within the first window 66. The second cap flange 32 is seated in the second window 68. The angled base 78 abuts an upper edge 90 of the first cap flange 30, and the angled base 84 abuts an upper edge 92 of the second cap flange 32. The angle of the angled base 78 facilitates retention of the first flange 74 to the first cap flange 30, and the angle of the angled base 84 facilitates retention of the second flange 76 to the second cap flange 32. This is because, for example, the angled base 78 and the angled base 84 contact the upper edge 90 and the upper edge 92 respectively at an innermost portion thereof. As a result, the first flange 74 and the second flange 76 are unlikely to slide off of and disengage the first cap flange 30 and second cap flange 32 respectively.

The mounting bracket 50 can be made of any suitable material, such as a suitable polymer. Therefore, upon insertion of the heat exchanger 10 between the first side wall 60 and the second side wall 62, the first and second side walls 60 and 62 will flex outward, away from each other, in order to allow the first and second cap flanges 30 and 32 to pass over the first and second flanges 74 and 76 and into the first window 66 and the second window 68 respectively. Corners of the first and the second windows 66 and 68 will also bend, particularly the corners closest to the slits, such as slit 70. The slit 70 of the first window 66 and the corresponding slit associated with the second window 68 can flex wider to alleviate stress on the corners. The slits, including slit 70, will be particularly effective at relieving stress when the height 72*a* thereof is less than the distance 72*b* that the slits are offset from the side of the first or second window 66 and 68. Stress on the slit 70, for example, is reduced by the rounded end 72*c* thereof.

Figure 4:
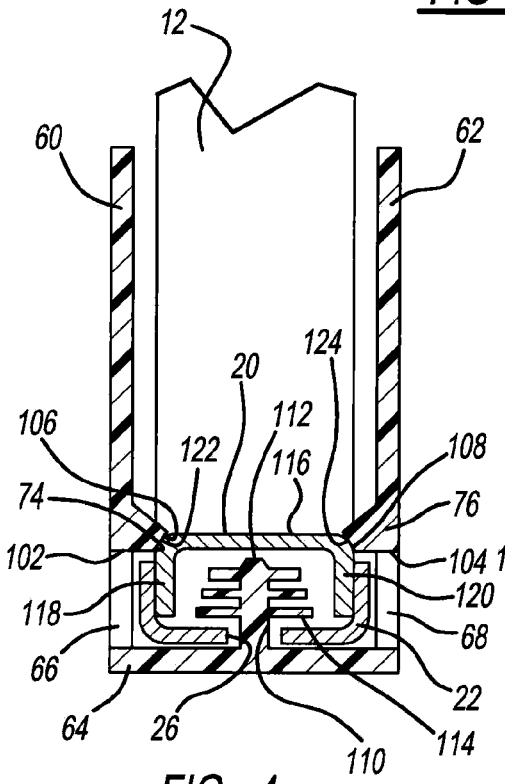
FIG. 4 is a cross-sectional view of an additional retention member according to the present teachings for securing the mounting bracket to the heat exchanger.

With additional reference to FIG. 4, the first flange 74 can include a planar base 102 and an angled inner surface 106. The planar base 102 defines an upper portion of the first window 66 and is opposite to the base 64. The planar base 102 and the base 64 extend in generally parallel and spaced apart planes. The angled inner surface 106 extends from the planar base 102 inwardly toward the second side wall 62. Similarly, the second flange 76 includes a planar base 104 and an angled inner surface 108. The planar base 104 defines an upper boundary of the second window 68. The planar base 104 extends in a plane that is generally parallel to, and spaced apart from, a plane along which the base 64 extends. The angled inner surface 108 extends from the planar base 104 inwardly towards the first flange 74.

A retention member 110 extends from the base 64. The retention member 110 includes a vertical portion 112 and a plurality of horizontal fins 114. The vertical portion 112 extends from the base 64 in a direction that is generally perpendicular to the base 64. The horizontal fins 114 extend from the vertical portion 112. The horizontal fins 114 extend generally perpendicular to the vertical portion 112. The retention member 110 can be made of any suitable material, such as a suitable polymer.

To secure the heat exchanger 10 to the mounting bracket 50 of FIG. 4, the heat exchanger 10 is positioned between the first and second side walls 60 and 62 of the mounting bracket 50 and pushed towards the base 64 such that the tank cap 22 contacts the first flange 74 and the second flange 76. As the heat exchanger 10 is pushed further into the mounting bracket 50 towards the base 64, contact between the tank cap 22 and the first and second flanges 74 and 76 will cause the first and second side walls 60 and 62, as well as the first and second flanges 74 and 76 to flex outward, thereby allowing the tank cap 22 to pass beyond the first and second flanges 74 and 76 to the base 64. As the tank cap 22 is pushed into contact with the base 64, the retention member 110 will enter the base aperture 26. As the retention member 110 enters the base aperture 26, the horizontal fins 114 collapse as they pass through the base aperture 26, and then expand to the position shown in FIG. 4 after the horizontal fins 114 pass through the base aperture 26, thereby securing the mounting bracket 50 and the heat exchanger 10 together.

To further secure the heat exchanger 10 to the mounting bracket 50, the first flange 74 and the second flange 76 abut the side plate 20 of the heat exchanger 10. More specifically, the side plate 20 includes a base 116 with a first leg 118 and a second leg 120 extending from opposite sides thereof. The first and second legs 118 and 120 extend generally perpendicular to the base 116. Between the base 116 and the first leg 118 is a first corner 122. Between the base 116 and the second leg 120 is a second corner 124. The angled inner surface 106 of the first flange 74 abuts the first corner 122 and the angled inner surface 108 of the second flange 76 abuts the second corner 124. This contact between the first flange 74 and the first corner 122 of the side plate 20, and between the second flange 76 and the second corner 124 of the side plate 20 retains the heat exchanger 10 within the mounting bracket 50 and enhances the connection therebetween.

Figure 5:
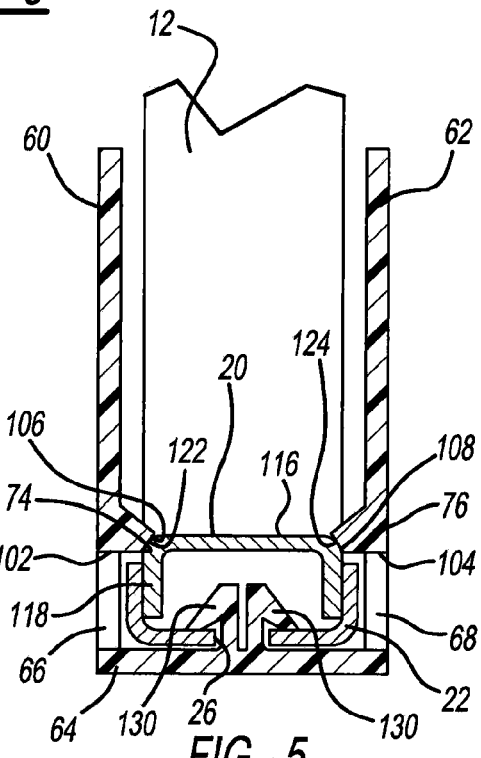
FIG. 5 is a cross-sectional view of yet another retention member for the mounting bracket, the retention member coupling the mounting bracket to the heat exchanger.

With additional reference to FIG. 5, another retention member for securing the base 64 of the mounting bracket 50 to the tank cap 22 of the heat exchanger 10 is illustrated. This retention member includes a first tab 130 and a second tab 132. The first and second tabs 130 and 132 are spaced apart from one another and extend in opposite directions. When the heat exchanger 10 is positioned between the first and second side walls 60 and 62 and pressed onto the base 64, the first and second tabs 130 and 132 compress together in order to allow them to pass through the base aperture 26. After the first and second tabs 130 and 132 pass beyond the base aperture 26, the first and second tabs 130 and 132 extend outward and contact an inner surface of the tank cap base 24 in order to secure the mounting bracket 50 to the tank cap 22 of the heat exchanger 10.

Figure 6:
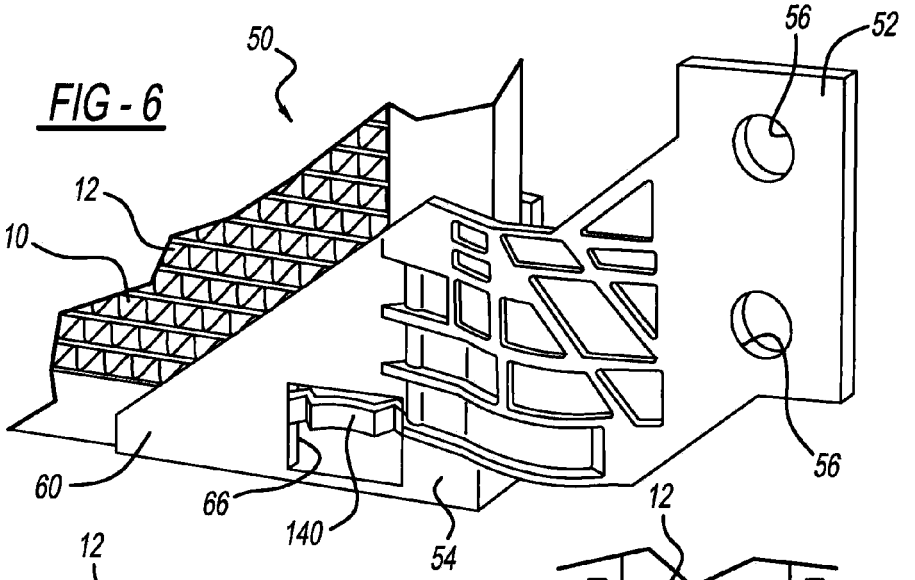
FIG. 6 is a perspective view of the mounting bracket including yet an additional retention member configured to secure the mounting bracket to the heat exchanger.
Figure 7A:
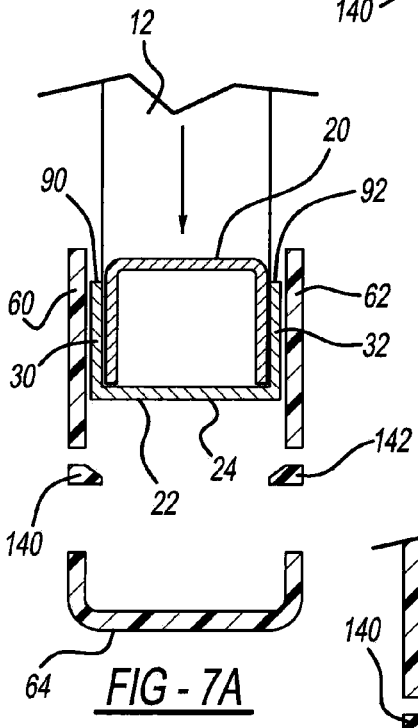
FIGS. 7A-7C illustrate connection of the mounting bracket to the heat exchanger with the retention member of FIG. 6.
Figure 7B:
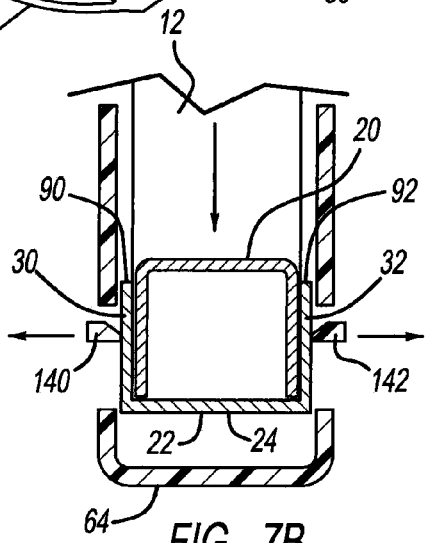
Figure 7C:
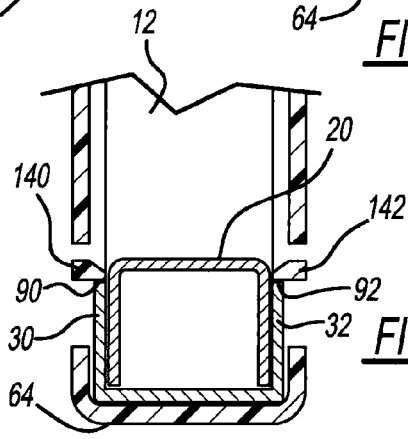

With reference to FIG. 6, an additional retention member of the mounting bracket 50 is illustrated at first horizontal tab 140. The first horizontal tab 140 is arranged within the first window 66 and extends across the first window 66 in a direction generally parallel to the plane in which the base 64 extends. With reference to FIGS. 7A-7C, the second side wall 62 includes a second horizontal tab 142 at the second window 68. The second horizontal tab 142 is generally similar to the first horizontal tab 140.

The first and second horizontal tabs 140 and 142 are generally flexible and movable between an inward and outward position. For example and with reference to FIG. 7A, as the heat exchanger 10 is inserted between the first and second side walls 60 and 62, and pushed towards the base 64, the tank cap 22 contacts the first and second horizontal tabs 140 and 142 to push them outward, as illustrated in FIG. 7B, which permits the tank cap 22 to pass to the base 64. With reference to FIG. 7C, after the first cap flange 30 and the second cap flange 32 pass beyond the first and second horizontal tabs 140 and 142, the first and second horizontal tabs 140 and 142 return to their inward position, at which they are biased, to contact the upper edge 90 of the first cap flange 30 and the upper edge 92 of the second cap flange 32 respectively in order to secure the heat exchanger 10 to the mounting bracket 50.

Figure 8:
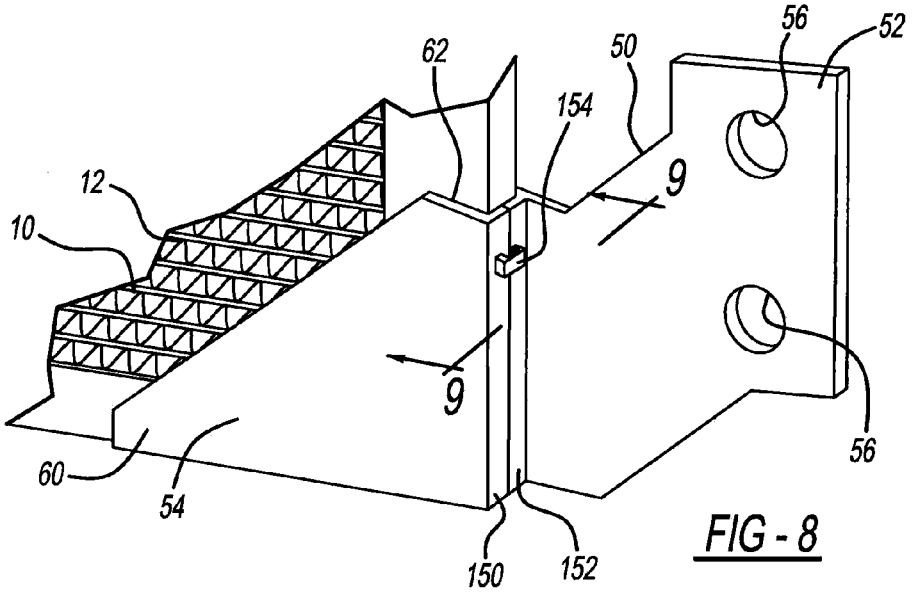
FIG. 8 is a perspective view of the mounting bracket including yet another retention member for securing the mounting bracket to the heat exchanger.

With additional reference to FIG. 8, the mounting bracket 50 can include a first end flange 150 and a second end flange 152. The first end flange 150 extends from the first side wall 60 and is generally perpendicular to the first side wall 60. The second end flange 152 extends from the second side wall 62 and is generally perpendicular to the second side wall 62.

Figure 9:
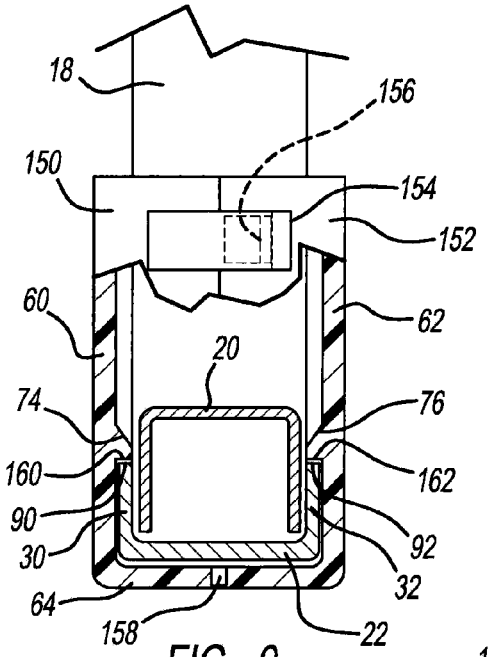
FIG. 9 is a cross-sectional view taken along line 9-9 of FIG. 8.

With additional reference to FIG. 9, a clip 154 extends from the first end flange 150. The clip 154 is configured to couple with a retention member 156 at the second end flange 152. Cooperation between the clip 154 and the retention member 156 secures the first end flange 150 and the second end flange 152 together.

The base 64 includes a hinge 158 (FIG. 9), which allows the first side wall 60 and the second side wall 62 to pivot away from one another in order to accept the heat exchanger 10 therebetween. Upon pivoting the first and second side walls 60 and 62 together to the closed position of FIG. 9, the first flange 74 and the second flange 76 abut the first cap flange 30 and the second cap flange 32 respectively in order to secure the heat exchanger 10 to the mounting bracket 50. More specifically, a planar base 160 of the first flange 74 abuts the upper edge 90 of the first cap flange 30 and a planar base 162 of the second flange 76 abuts the upper edge 92 of the second cap flange 32.

Figure 11:
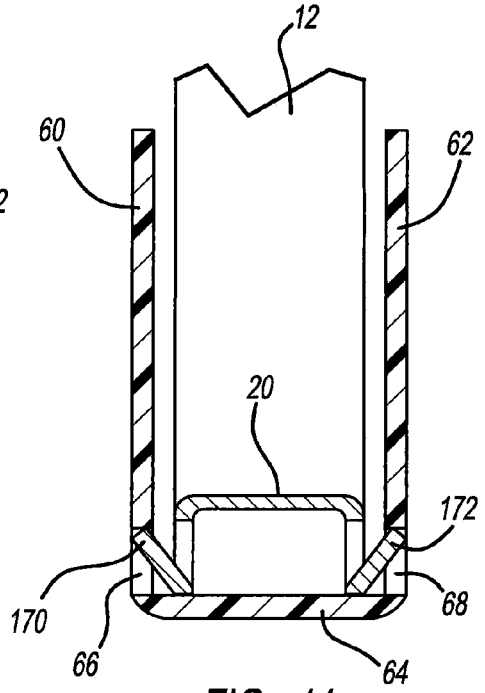
FIG. 11 is a cross-sectional view taken along line 11-11 of FIG. 10.
Figure 10:
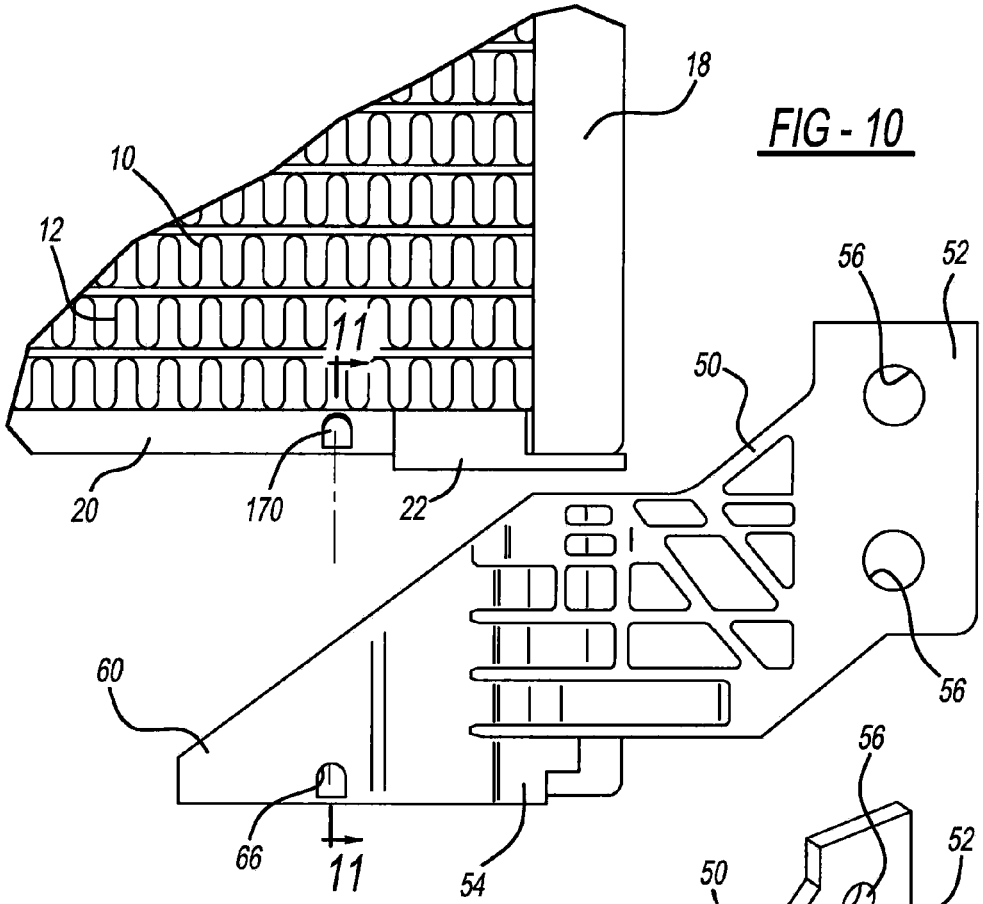
FIG. 10 is a side view of the heat exchanger including a tab for securing the mounting bracket to the heat exchanger.

With reference to FIGS. 10 and 11, the heat exchanger 10 can include a retention member at the side plate 20 in the form of a first tab 170 at the first side 14 of the heat exchanger 10, and a second tab 172 (FIG. 11) at the second side 16 of the heat exchanger 10. The first window 66 of the first side wall 60 of the mounting bracket 50 is sized and shaped to receive the first tab 170. The second window 68 of the second side wall 62 is sized and shaped to cooperate with the second tab 172.

The first and second tabs 170 and 172 can be flexible. Therefore, and with reference to FIG. 11, upon insertion of the heat exchanger 10 between the first and second side walls 60 and 62 of the bracket 50, the first and second tabs 170 and 172 pivot inward until the first and second tabs 170 and 172 reach the first and second windows 66 and 68 respectively. At the first and second windows 66 and 68, the first tab 170 extends outward and into the first window 66, and the second tab 172 extends outward and into the second window 68 in order to lock the first and second tabs 170 and 172 within the first and second windows 66 and 68 respectively. The first and second side walls 60 and 62 can also be flexible to facilitate insertion of the heat exchanger 10 therebetween and to more readily accommodate passage of the first and second tabs 170 and 172 into the first and second windows 66 and 68.

Figure 12:
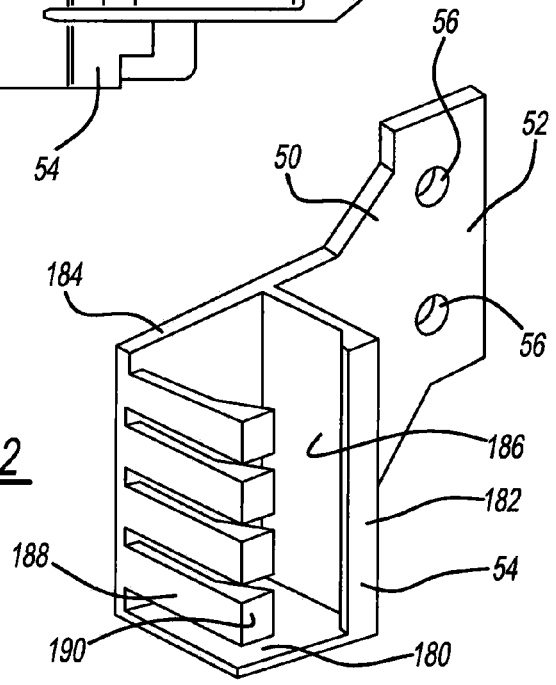
FIG. 12 is a perspective view of the mounting bracket including yet another retention member for securing the mounting bracket to the heat exchanger.
Figure 13:
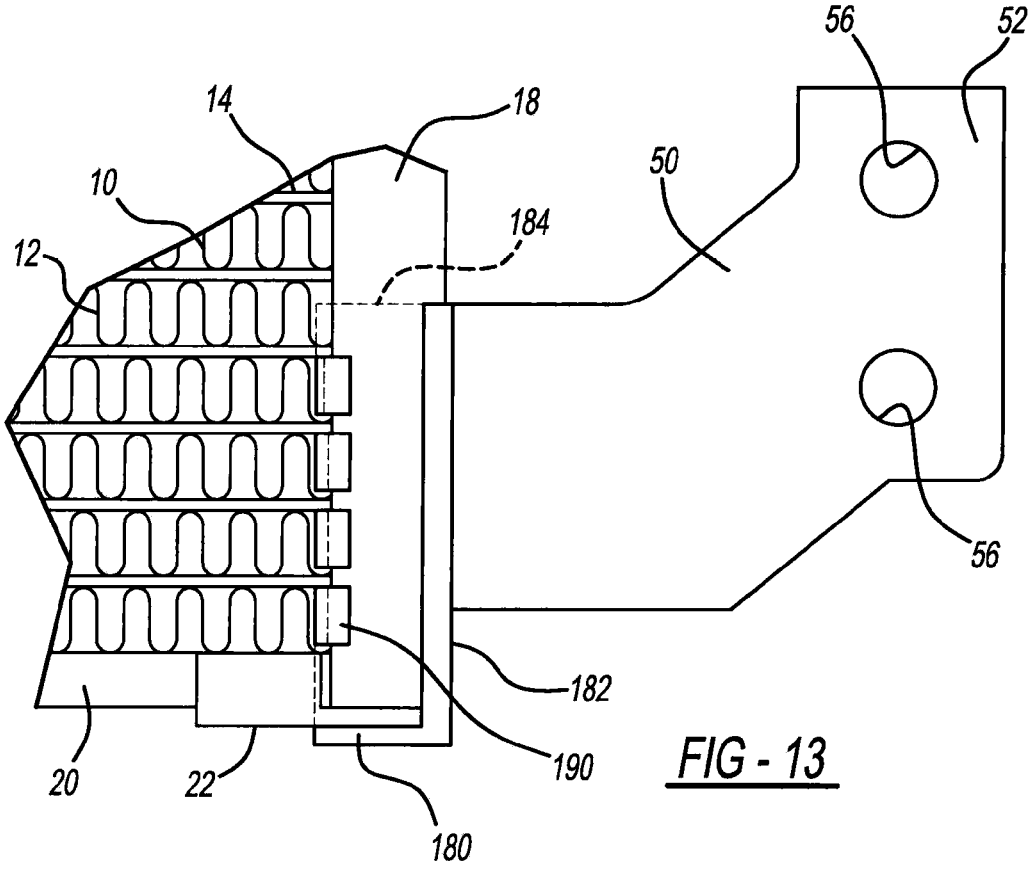
FIG. 13 is a side view of the mounting bracket secured to the heat exchanger with the retention member of FIG. 12.

As illustrated in FIGS. 12 and 13, the heat exchanger engagement portion 54 of the mounting bracket 50 can include a base 180, a first side wall 182, a second side wall 184, and an end wall 186. The end wall 186 extends from the second side wall 184 and is generally perpendicular to the second side wall 184. The first side wall 182 extends from the end wall 186 and is generally perpendicular to the end wall 186. The first side wall 182 extends from the end wall 186 generally parallel to the second side wall 184, but the first side wall 182 is shorter than the second side wall 184.

Extending from a distal end of the second side wall 184 is a plurality of flexible fingers 188. The fingers 188 are spaced apart and extend generally perpendicular to the second side wall 184. The fingers 188 extend across the base 180 generally parallel to the end wall 186 and include flanges 190 at distal ends of the fingers 188. The flanges 190 are opposite to and spaced apart from the first side wall 182 to define a gap therebetween.

As illustrated in FIG. 13, the second side wall 184 abuts the second side 16 of the heat exchanger 10, and the first side wall 182 abuts the first side 14 of the heat exchanger 10. The end wall 186 abuts the tank 18 and the fingers 188 extend through the heat exchanger core 12. The fingers 188 abut an inner surface of the tank 18 and the flanges 190 extend around the tank 18 to secure the bracket 50 to the tank 18. The base 180 abuts the tank cap 22 in order to support the tank 18 and the heat exchanger 10 generally.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A mounting bracket for a heat exchanger comprising:

a heat exchanger engagement portion including: a first sidewall; a second sidewall spaced apart from and opposite to the first sidewall; and a retention member, each of the first sidewall and the second sidewall define a window with only a single slit extending from each window between opposite sides of each window; and a mounting portion extending from the heat exchanger engagement portion and configured for fixedly mounting the mounting bracket;

wherein cooperation between the retention member and the heat exchanger secures the heat exchanger to the mounting bracket.

2. The mounting bracket of claim 1, wherein the engagement portion includes a base extending between the first sidewall and the second sidewall.

3. The mounting bracket of claim 1, wherein the mounting portion defines at least one mounting aperture.

4. The mounting bracket of claim 1, wherein the mounting bracket is entirely polymeric.

5. The mounting bracket of claim 1, wherein the retention member includes first and second flanges extending inward from the first and the second sidewalls respectively and each including an angled base portion configured to abut a tank cap of the heat exchanger.

6. The mounting bracket of claim 1, wherein the retention member includes a vertical portion with a plurality of horizontal fins extending from opposite sides thereof, the vertical portion and the horizontal fins are configured for receipt within an aperture defined by a tank cap of the heat exchanger.

7. The mounting bracket of claim 1, wherein the retention member includes a flexible tab configured for receipt within an aperture defined by a tank cap of the heat exchanger.

8. The mounting bracket of claim 1, wherein the retention member includes a flexible tab at a window defined by the engagement portion, the flexible tab configured to mate with a flange of a tank cap of the heat exchanger.

9. The mounting bracket of claim 1, wherein the retention member includes a pair of opposing flanges each configured to mate with one of a pair of flanges of a tank cap of the heat exchanger, a first one of the pair of opposing flanges extends from the first sidewall and a second one of the pair of opposing flanges extends from the second sidewall.

10. A mounting bracket for a heat exchanger comprising:

a first flexible sidewall;

a second flexible sidewall;

a base extending between the first flexible sidewall and the second flexible sidewall;

a retention member configured to retain the mounting bracket in cooperation with the heat exchanger; and a mounting portion extending from the engagement portion and configured for fixedly mounting the mounting bracket at an installation location;

wherein:

the mounting bracket includes a polymer; and each one of the first sidewall and the second sidewall define a window with only a single slit extending from each window between opposite sides of each window.

11. The mounting bracket of claim 10, wherein the retention member includes a flexible tab.

12. The mounting bracket of claim 10, wherein the retention member includes a plurality of flexible fins.

13. A mounting bracket for a heat exchanger comprising:

a first sidewall configured to abut a first side of the heat exchanger;

a second sidewall opposite to the first sidewall and extending parallel to the first sidewall, the second sidewall configured to abut a second side of the heat exchanger;

a base portion extending between the first sidewall and the second sidewall;

a first flange extending inward from the first sidewall towards the second sidewall, and a second flange extending inward from the second sidewall towards both the first sidewall and the first flange, each one of the first and the second flanges including an angled base portion configured to abut a tank cap of the heat exchanger to retain the mounting bracket in cooperation with the heat exchanger; and a mounting portion extending from at least one of the first sidewall and the second sidewall, the mounting portion configured to secure the mounting bracket at a predetermined position;

wherein:

the mounting bracket is entirely polymeric; and each one of the first sidewall and the second sidewall defines a window with only a single slit extending from each window between opposite sides of each window, each window is configured to receive a flange of a tank cap of the heat exchanger.

14. The mounting bracket of claim 13, further comprising a pair of flexible tabs extending from the base.

* * * * *